US005536225A

United States Patent [19]

Neuberg et al.

[11] Patent Number: 5,536,225

[45] Date of Patent: Jul. 16, 1996

[54] SKIING SIMULATOR SYSTEM COMBINING SKI TRAINING AND EXERCISE

[75] Inventors: Gerald W. Neuberg, Irvington, N.Y.; Peter P. Meserol, Montville, N.J.

[73] Assignee: Mogul Master Partners, Irvington, N.Y.

[21] Appl. No.: 499,309

[22] Filed: Jul. 7, 1995

[51] Int. Cl.[6] ..... A63B 69/18; A63B 22/00

[52] U.S. Cl. ..... 482/71; 482/51; 482/52

[58] Field of Search ..... 482/70, 71, 52, 482/53, 74, 148; 601/27, 33, 34, 35

[56] References Cited

U.S. PATENT DOCUMENTS

| | | | |
|---|---|---|---|
| 3,731,919 | 5/1973 | Schurch | 482/71 |
| 4,396,189 | 8/1983 | Jenkins | 482/71 |
| 4,781,372 | 11/1988 | McCormack | 482/70 |
| 4,811,941 | 3/1989 | Elo | 482/70 |
| 5,284,460 | 2/1994 | Miller | 482/71 |
| 5,290,211 | 3/1994 | Stearns | 482/70 |

*Primary Examiner*—Stephen R. Crow
*Attorney, Agent, or Firm*—Perman & Green

[57] ABSTRACT

A system combining ski training and exercise includes side-by-side swing arms which are pivotally mounted on a frame with lower ends being free to swing through first and second arcs, respectively, resulting in both lateral and elevational travel of the lower ends. For receiving the associated foot of a subject, each swing arm has a foot platform mounted for elevational travel therealong as imparted by the subject between the upper and lower ends. The foot platforms are interconnected enabling the subject whose feet are received thereon to selectively cause the left foot platform and the right foot platform to travel elevationally and the left swing arm and the right swing arm to travel through first and second arcs, respectively, to thereby perform a series of successive stances and movements both laterally and elevationally which simulate a skiing run. The system of the invention may use ski boots and bindings, or other arrangements, for receiving the feet of the subject on the foot platforms. In one embodiment, the left and right foot platforms may be so interconnected as to cause stepping travel thereof; in another embodiment, they may be so interconnected as to cause hopping travel. To simulate actual conditions, drag is imparted to the elevational travel of the foot platforms and the arcuate travel of the swing arms can be braked according to the positioning of the subject's feet. Ski poles are attached to the frame by an elastomeric member providing universal hinged movement.

23 Claims, 6 Drawing Sheets

SKIING SIMULATOR SYSTEM COMBINING SKI TRAINING AND EXERCISE

BACKGROUND OF THE INVENTION

1. Field of the Invention

The present invention relates generally to skiing simulation apparatus and, more particularly, to such apparatus combining ski training and exercise and providing lateral and vertical motion, variable stance, multiaxial foot rotation and voluntary weight transfer, all of which enable realistic simulation of a full range of downhill ski techniques and terrain conditions.

2. Description of the Prior Art:

The sport of alpine or downhill snow skiing is enjoyed by millions of Americans and millions more worldwide but is extremely demanding. Safe and effective skiing requires considerable strength, endurance, balance and coordination as well as substantial technical skill. These challenges are met by all skiers, from beginners to experts, who must constantly test their limits as they strive to improve their technique and to master more and more difficult terrain. These difficulties are further compounded by the stressful environmental conditions under which the sport is performed. In the mountains, skiers are exposed to varying combinations of altitude, cold, alternating with overheating due to bursts of strenuous activity, wind, bright sun and snowfall, all of which can impair mental and physical performance.

The seasonality of the sport makes the physical conditioning necessary for safe and successful skiing difficult to sustain in the off-season. Unlike racers, who ski year-round by travelling wherever the snow is located, most recreational skiers are unable to participate for more than a small portion of each year. They clearly need a more practical way to practice and stay in shape, in order to get the most out of their ski vacations and to avoid injury. In the past, off season training options have been limited primarily to weight training and nonspecific aerobic activities such as running and cycling. Recently, rollerblading has introduced a cross-training activity with greater similarity to downhill skiing, but with its own limitations, including the need for an empty paved incline and a relatively high risk of injury. Unfortunately, these alternative exercise regimens rarely, if ever, emulate the parameters of actual on-slope skiing. Due to undertraining, recreational skiers, even those in relatively good condition, typically must endure several days of soreness and stiffness (i.e. muscle injury) at the beginning of their vacations before they "get their ski legs" and perform comfortably. Thus, for many or most skiers, mastery and enjoyment of the sport are limited by inadequate conditioning and insufficient practice.

Many of these problems would be greatly diminished by the development of a realistic ski simulator. The advantage of a ski simulator is the potential for a safe, ski-specific exercise that can be enjoyed at home or at the gym, any time and in any weather. An optimal device would reproduce the feel of skiing by emulating the correct anatomic positioning and physiologic loading experienced during a variety of ski techniques under various terrain conditions. The exercise intensity also should be adjustable, allowing skiers at all levels to develop their strength, endurance, balance, coordination and skill. A realistic downhill ski trainer would be suitable for off-slope and off-season ski simulation, conditioning and even instruction.

The opportunity to work face-to-face with an athlete performing under relaxed, controlled indoor conditions would add a new dimension to ski instruction and coaching. Ski schools could benefit by supplementing their regular mountain programs with off-slope and off-season instruction. A realistic ski simulator could be used to teach essential ski fundamentals (i.e. stance, balance, pressure, edging, steering, weight transfer, hip angulation, vertical motion, upper body position and poling) as well as integrated technique. Individual or group indoor instruction outside normal lift operating hours or during harsh weather would be valuable for skiers seeking to speed their progress and/or minimize cold exposure. Currently, skiers in group lessons are often frustrated by the need to repeatedly stop moving in order to receive instruction on the mountain. Coupling of on-mountain lessons with morning or evening indoor demonstrations and supervised simulation would help optimize the pace of outdoor lessons and maximize ski mileage. Dry land classes would be particularly useful for assessing and enhancing the readiness of children and physically challenged skiers to face mountain conditions.

The technical skills of alpine skiing range from the beginner level (snowplow turn and wedge christie) to intermediate (stem christie and parallel turns) to advanced (short swing, step christie and mogul skiing). Reproduction of these techniques requires analysis of their underlying anatomic and physiologic elements. We can define a limited number of basic elements which can be integrated to produce the full spectrum of alpine skills. These include lateral (side-to-side) leg motion with a variable stance, vertical leg motion (flexion/extension), and voluntary weight transfer effected by edging and by a resistive pole plant. Two additional degrees of freedom experienced during free skiing include inward and outward toe rotation and ankle flexion/extension.

Prior art citations relate primarily to cross-country rather than downhill ski simulation. Specific references are U.S. patents to Engel et al.: U.S. Pat. No. 5,026,866 and Chi: U.S. Pat. No. 5,299,966. A limited number of downhill ski trainers also have been available. These devices, which have been discussed in the recent press, for example, in *Consumer's Reports,* September 1994, pages 582 et. seq. and in *Skiing Magazine,* October 1994, pages 66 et. seq. are very similar in their basic elements. The principal feature is a basic side-to-side motion, resembling the repeated turns of a skier making a controlled descent. Unfortunately, this lateral motion, while necessary, is not sufficient to reproduce the feel of downhill skiing. These designs are all limited by their fixed closed stance, absence of vertical motion, lack of voluntary weight transfer and lack of vigorous poling. On previous devices, the subject traverses a convex track rising 6 or 8 inches from base to peak but, due to the fixed closed stance, the feet are separated vertically by no more than a few inches at a time. Weight transfer is accomplished upon recoil of a big rubber band not controlled by the subject. The old models are also equipped with unattached poles, which are used for extra balance but do little to assist the weight transfer.

Because of these limitations, prior art devices cannot reproduce the full spectrum of modern ski techniques. In fact, they can only approximate a nonaggressive, closed track parallel turning technique used primarily by advanced intermediate skiers. They achieve nothing else above or below it in the hierarchy of alpine skills as taught, for example, in a document entitled "Strategies for Teaching, American Teaching System", and promoted by Professional Ski Instructors of America (Publishers Press, Salt Lake City, 1987). This isolated, invariant exercise thus fails to meet the needs of most skiers. The lateral motion is appropriate, but modern athletic skiing also requires dynamic vertical motion, meaning flexion and extension of the hips and knees. This has not been addressed in prior art citations.

The second problem is stance which ought not to be fixed and closed but variable, permitting each leg to execute its lateral motion independently. Beginners must maintain a wide stance to stay in balance. These skiers will not be comfortable on a trainer a requiring a fixed closed stance. In contrast, because of their excellent balance, expert skiers usually can handle a closed stance, but advanced techniques (e.g. step christie) also require a variable stance, without which better skiers would feel constrained. The third drawback of the prior art resides in the weight transfer, which should be under voluntary control of the subject, but instead depends upon passive recoil of an elastic band. Ordinarily, edge control creates a stable platform that permits precise weight changes and application of tremendous lateral carving forces. Without controlled weight transfer, the subject has to be quite tentative in executing the lateral motion, limiting the enjoyment and value of the workout. Finally, realistic poling would incorporate lateral arm resistance as an active part of weight transfer.

SUMMARY OF THE INVENTION

It was in light of the foregoing that the present invention was conceived and has now been reduced to practice. The present invention which relates to a system combining ski training and exercise includes side-by-side swing arms which are pivotally mounted on a frame with lower ends being free to swing through first and second arcs, respectively, resulting in both lateral and elevational travel of the lower ends. For receiving the associated foot of a skier, each swing arm has a foot platform mounted for elevational travel therealong as imparted by the skier between the upper and lower ends. The foot platforms are interconnected enabling the skier whose feet are received thereon to selectively cause the left foot platform and the right foot platform to travel elevationally and the left swing arm and the right swing arm to travel through first and second arcs, respectively, to thereby perform a series of successive stances and movements both laterally and elevationally which simulate a skiing run. The system of the invention may use ski boots and bindings, or other arrangements, for receiving the feet of the skier on the foot platforms. In one embodiment, the left and right foot platforms may be so interconnected as to cause stepping travel thereof; in another embodiment, they may be so interconnected as to cause hopping travel. To simulate actual conditions, drag is imparted to the elevational travel of the foot platforms and the arcuate travel of the swing arms can be braked according to the positioning of the skier's feet. Ski poles are attached to the frame by an elastomeric member providing universal hinged movement.

The present invention uniquely addresses the correct anatomic and physiologic elements of modern skiing by incorporating vertical motion, variable stance, and controlled weight transfer along with lateral motion. In this manner, a more realistic simulation of a greater variety of downhill ski techniques is permitted resulting in a more dynamic workout. The principal innovation is the insight into the nature of the vertical motion in alpine skiing and the manner in which lateral and vertical motion are superimposed.

As stated above, the prior art represents a primarily lateral motion technology with a minimum of vertical motion. The present invention discloses a completely different approach. Rather than building upon lateral motion, the concept of the present invention begins, instead, with an analysis of the vertical motion. Recognizing that the vertical motion in skiing is equivalent to stair climbing or stepping, with the same opposing leg positions of flexion and extension, alternating with extension and flexion, the design of the invention begins with this vertical stepping action. Prior art stepping devices such as are disclosed in U.S. patents to Del Mar: U.S. Pat. No. 4,720,093 and Miller: U.S. Pat. No. 5,242,343, all function in a linear fashion, always in the midline. The present invention introduces stepping into the lateral plane. A skier's legs are free to move not just vertically but also swing laterally (out of the midline, left or right, apart or together), such that the inside ("uphill") leg flexes while the outside ("downhill") leg extends. Thus, the invention schematically superimposes vertical stepping with side-to-side motion in a one-to-one ratio. This combination of vertical and independent lateral motion generates a variety of lateral stepping patterns that simulate free skiing. Specifically, right leg lateral extension (accompanied by left leg flexion) reproduces a left turning position, whereas left leg lateral extension (with right leg flexion) simulates a right turning position. Various combinations of open and closed stance executed during the lateral stepping exercise will reproduce the full spectrum of alpine turning techniques (see Table 1). Furthermore, whereas previous trainers permit the feet to travel through only a single arc in space, the present invention encompasses an unlimited number of lateral stepping patterns.

To the design just described are added the additional elements of multiaxial foot rotation and hinged poles. All three forms of foot rotation are relevant to ski simulation: (1) an "edging" action (ankle eversion/inversion), (2) a "rotary" action (inward/outward toe rotation), and (3) ankle extension/flexion. In order to create a stable platform for voluntary weight transfer, a brake mechanism is provided that mimics ski edging, as well as hinged poles capable of supplying voluntary lateral resistance (mimicking an actual poleplant) to assist the lateral weight transfer and to involve the upper body in the exercise. Since actual ski edging and turn carving result from inward rotation of the weighted outside ski along its long axis (with or without edging of the inside ski via outward rotation), the invention incorporates the same foot movements to activate a brake capable of decelerating the lateral motion and/or vertical motion of the legs on demand. Prior art devices did permit some rotation around this axis, yet failed to incorporate a braking mechanism.

In addition, since steering of skis on an actual slope results from so-called "rotary" foot control as well as edging and carving skills, the ability to alter toe to toe orientation is provided. Specifically, inward toe rotation around the axis of the tibia occurs naturally while an edged ski carves a turn under a weighted leg. When both legs are weighted with an open stance, simultaneous inward toe rotation occurs, producing the snowplow or wedge position (toes together, heels apart). Active "rotary" foot control or "pivoting" must be utilized (along with stance control involving the hip adductor and abductor muscles) to maintain the desired position. Similarly, during wedge turns (as well as more advanced turning techniques), while the outside ski is carving, the inside ski must be guided by a rotary steering action, in this case involving predominantly outward toe rotation, in order to maintain the desired alignment of the skis and to oppose the natural tendency of the ski tips to cross.

Finally, since the flexed leg often appears more natural and comfortable in a heel-up, toe-down position, the ability to alter the heel-toe orientation is also provided. Addition of these rotary movements around the three orthogonal axes of the foot to the lateral stepping design yields an unprecedented five degrees of freedom in a field where prior art consisted of just one or two degrees of freedom. Numerous adjustable features permit alteration of "terrain" conditions and exercise intensity.

Lateral stepping will effectively simulate ski techniques used on relatively smooth terrain but, to simulate mogul (bump) skiing, a slightly different exercise will be needed. In the bumps, vertical motion remains essential, but there is not enough space to use the legs independently. Instead, both legs are simultaneously flexed and then extended in order to absorb the changing terrain. As a mogul is traversed, the knees must flex, "sucking up" the rising terrain, to keep the upper body steady and to avoid becoming airborne. In the trough between bumps, the legs must extend to keep the skis in contact with the snow and ensure a smooth ride. Thus, the vertical motion of mogul skiing resembles squat jumping or hopping rather than stepping. By combining this action with lateral motion (such that one cycle of tandem flexion/extension accompanies each leftward or rightward lateral swing), patterns of lateral hopping are derived that simulate mogul skiing.

The lateral stepping and hopping exercises described above both entail alternating leg flexion and extension. In both cases, the vertical motion of the two legs is dependent, occurring either in an opposing fashion (stepping) or in a tandem fashion (hopping). A third form of vertical motion to be provided in combination with lateral motion is with the legs completely independent. In this mode, the device would permit both tandem and opposing leg movements, but the vertical motion of one leg would not be dependent upon the vertical motion of the other. In other words, when one leg is extended, the other leg is passively flexed in the stepping mode or passively extended in the hopping mode whereas, in the independent mode, the second leg can be placed in any desired vertical position.

By virtue of its novel ability to reproduce the full range of ski techniques from beginner to expert, the present invention promises to achieve uniquely realistic and dynamic alpine ski simulation, conditioning and instruction. Additional applications include on-line ergometric performance assessment to assist racers during usual training or rehabilitation after injury, for which a means is provided. Various video feedback applications may be employed, including slalom gates for additional challenge and virtual reality-type mountain tours. Such applications will require position and motion sensors as well as development of suitable software for graphic display. For non-skiers, the invention will provide novel cross training possibilities for a variety of sports—such as football, soccer, basketball, skating and tennis—that require dynamic vertical and lateral motion. Thus, many athletes can benefit from the unique lateral stepping and hopping exercises which, for many, will provide a first introduction to the joys of skiing. Of course, with the legs fixed in the midline, the device can always be used as a simple vertical stepping or hopping device.

In short, the present invention serves to introduce lateral motion to a stepping device, enabling wide stance stepping or lateral stepping. It is the first apparatus known to the inventors enabling a vertical or lateral hopping exercise, which simulates mogul skiing. Also, the invention offers the first combination of lateral and vertical leg motion in any exercise device. The invention is the only ski trainer with variable stance and controlled weight transfer. The invention is a ski trainer capable of traveling an unlimited number of spatial arcs, unlimited for every given lateral range, stance and step amplitude, as opposed to single arc designs known in the prior art. The invention represents the first known ski trainer incorporating multiaxial foot rotation, that is, around all three ankle axes, for a total of five degrees of freedom, compared to one or two in prior art. The invention is the only known ski trainer capable of simulating full range of alpine techniques from beginner to expert, as opposed to isolated and invariant closed, track parallel technique. Further, the invention is the only known ski trainer capable of simulating a range of terrain conditions, that is, varying steepness and smooth versus bumpy terrain. Also, the invention is the first known downhill ski trainer with ergometry.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

DETAILED DESCRIPTION OF THE PREFERRED EMBODIMENT

Figure 1:
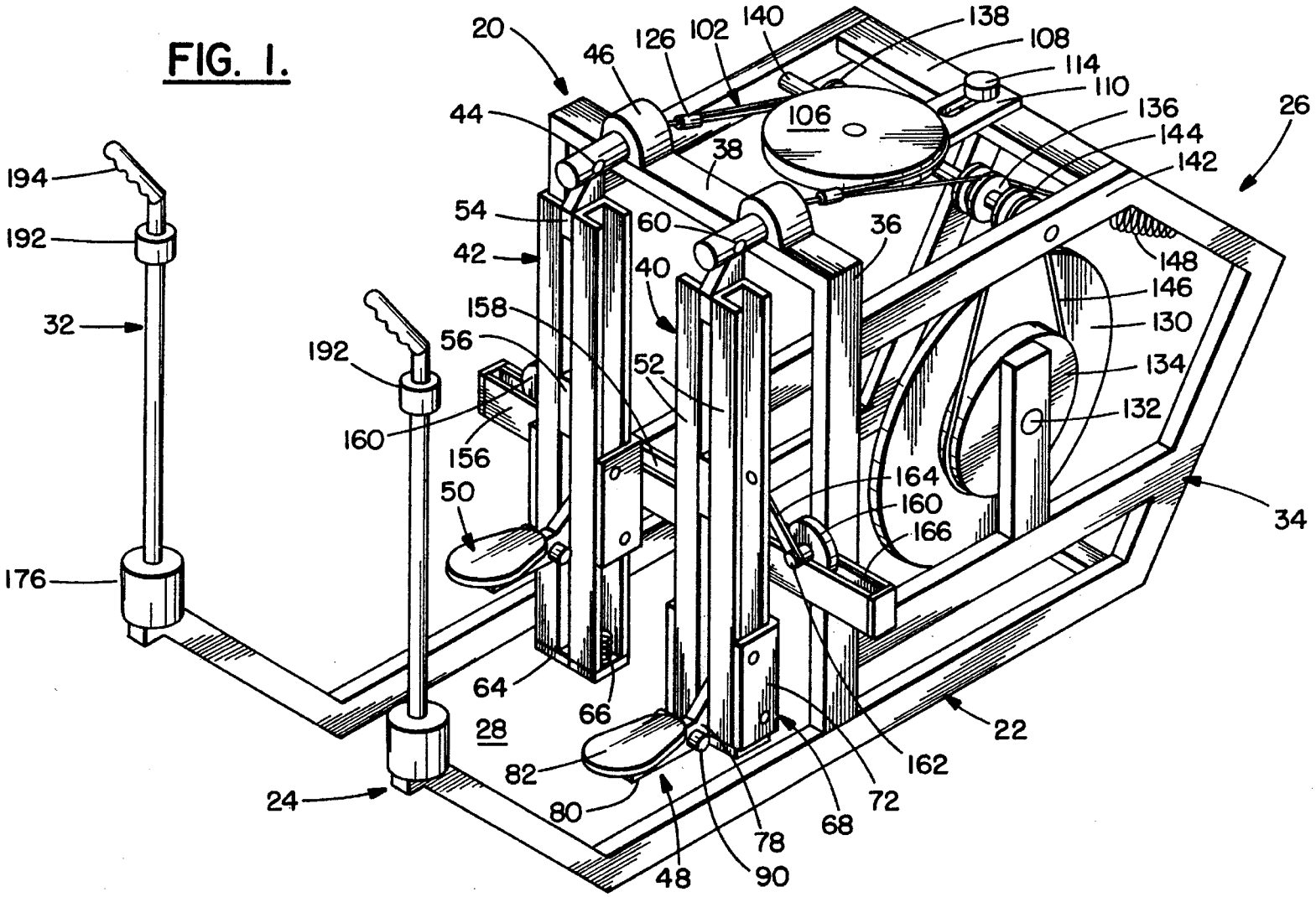
FIG. 1 is a perspective view of a skiing simulator system which combines both ski training and exercise as embodied by the present invention.
Figure 2:
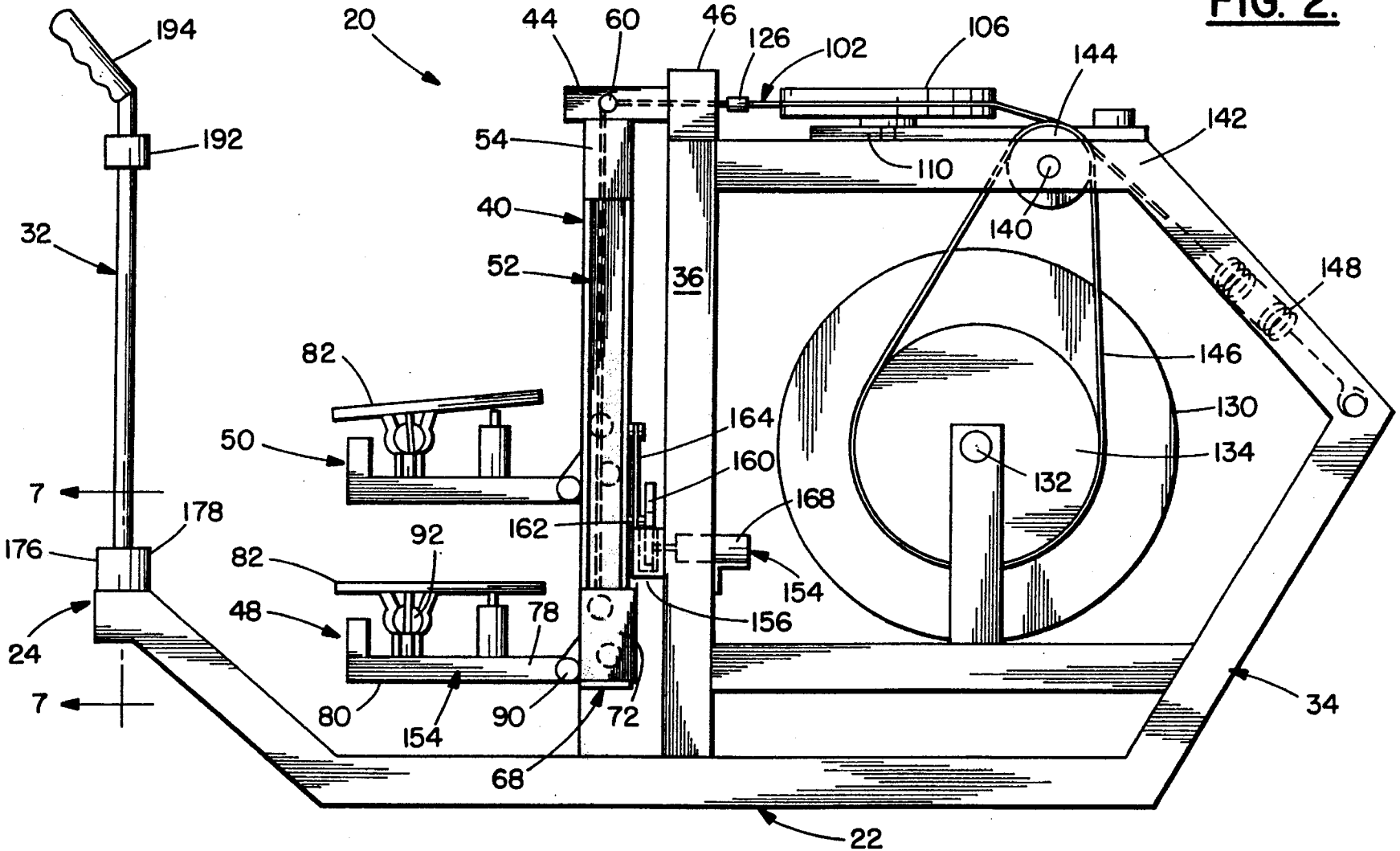
FIG. 2 is a side elevation view of the skiing simulator system illustrated in FIG. 1.

Turn now to the drawings and, initially, to FIGS. 1 through 4 which illustrate a skiing simulator system 20 generally embodying the present invention. The system 20, which combines ski training and exercise, may be mounted on a rectangular base 22 with the short sides forming front and rear ends 24, 26, respectively.

A front portion of the base 22 supports an exercise deck 28 and at the extreme front of the system, a pair of angled extension members 30 as provided for supporting a pair of ski poles 32. The ski poles 32 may be detachable for ease of storage and transport and the lateral spacing between the ski poles 32 may be adjustable in a suitable manner (not illustrated) to accommodate a variety of sizes of skiers.

A rear portion of the base 22 supports a box-shaped frame 34 which houses mechanisms to be described below. The rectangular front of the frame 34 comprising two opposed side pillars 36 and an upper cross bar 38, supports the principal moving parts of the system 20. Two swing arms 40, 42 are suspended vertically over the exercise deck 28 by use of hollow swing pins 44 pivotally anchored by pillow blocks 46 mounted atop the upper cross bar 38. The swing arms 40, 42 are referred to hereinafter as left swing arm 40 and right swing arm 42, since they are positioned, respectively, to the left and to the right of a skier using the system 20. Note that a skier using the system 20 is positioned above the exercise deck 28 and faces toward the ski poles 32. The swing arms 40, 42 are mounted on the cross bar 38 a suitably spaced distance to accommodate a skier using the system 20. The distance between the swing arms may approximate the distance between the hip joints of an average skier. It may be desirable to provide width adjustment for the skiing simulator 20 but for simplicity of disclosure, such a construction is not illustrated.

Each swing arm 40, 42 is generally upright and extends between upper and lower ends and, as described above, is pivotally mounted on the frame 34 at its upper end with the lower end being free to swing through an arc resulting in both lateral and elevational travel of the lower end. The arcs through which the swing arms 40, 42 travel are coplanar resulting in both lateral and elevational travel for the lower ends thereof.

A left foot platform 48, adapted to receive the left foot of a skier, is mounted on the left swing arm 40 for elevational travel therealong as imparted by the skier between the upper and lower ends of the swing arm 40. A right foot platform 50, adapted to receive the right foot of a skier, is similarly mounted on the right swing arm for travel therealong as imparted by the skier between the upper and lower ends of the swing arm 42. The left and right foot platforms are interconnected in a manner to be described, thereby enabling the skier to selectively cause the left foot platform and the right foot platform to travel elevationally, either for stepping or for hopping. This construction together with the ability of the swing arms 40, 42 to travel through arcs, as mentioned above, enables the system 20 to thereby perform a series of successive stances and movements both laterally and elevationally which simulate a skiing run.

An adequate length permits the swing arms 40, 42 to cover a comfortable lateral range with a minimum of angulation. For example, with an arm length of 39 inches and a 12 inch spacing at the top, that is, between longitudinal axes of the swing pins 44, lateral ranges of three, four, and five feet at the free bottom ends (representing mild, moderate and vigorous exercise, respectively) can be covered with a maximum of 18, 28 and 38 degrees of angulation, respectively; whereas a greater arm length of 42 inches (again assuming a 12 inch spacing) requires only 16, 25 and 35 degrees of angulation to attain the same lateral ranges.

Figure 5:
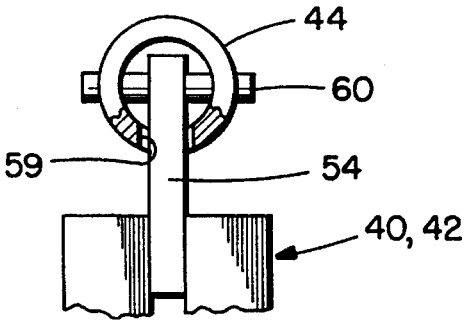
FIG. 5 is a detail front elevation view, certain parts being cut away and shown in section for clarity, of certain components illustrated in FIGS. 1–4.

Each swing arm 40, 42 has three principal components oriented vertically. The left and right sides of the arm shaft are formed from identical channel elements 52 being C-shaped in cross section and oriented back to back. These channel elements 52 are joined together at the top, middle and bottom by short spacer elements 54, 56, 58, respectively. Viewing FIG. 5, the top spacer element 54 extends above the channel elements 52 and through a suitably shaped and sized opening 59 into the interior of the swing pin 44 and is fixed to the swing pin 44 by a cross pin 60 (FIG. 5). In this manner, the swing arms are suspended from their associated swing pins. This construction permits the swing arms 40, 42 to swing freely on the frame 34 through the arcs described above. A central gap 62 (FIG. 4) between middle and bottom spacers 56, 58 and channel elements 52 defined on opposite sides of each swing arm 40, 42 is designed to accommodate the foot platforms 48, 50. At least 24 inches of unimpeded vertical travel is desirable, for example, to permit a full spectrum of step amplitudes, to be described.

Each of the swing arms 40, 42 includes a transverse base member 64 which is suitably fixed to and extends across its lower end. A resilient stop member in the form of a compression spring 66 (FIG. 1) is fixed, as by welding, on the base member and extends in an upward direction. As will be described, the free end of the spring 66 is engageable by an associated foot platform 48, 50 as the foot platform approaches the lower end of the swing arm and serves to absorb the resulting impact.

Figure 6:
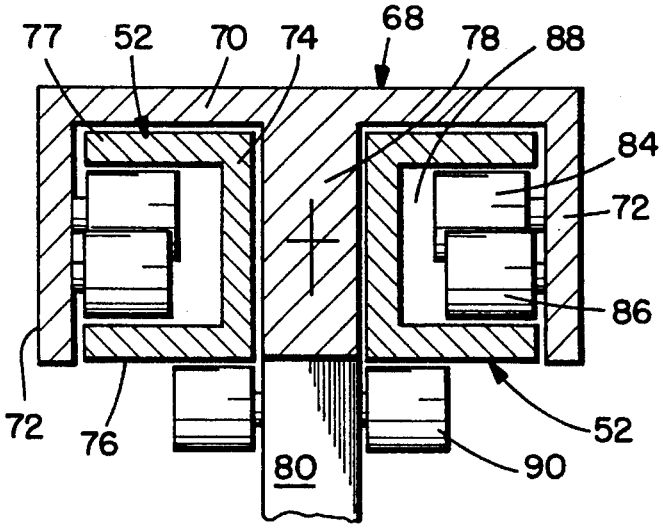
FIG. 6 is a cross-section view taken generally along line 6—6 in FIG. 4.

Each foot platform 48, 50 includes a collar 68 (FIG. 6) that rides up and down along the length of its associated swing arm 40, 42. Viewed from above, that is, in cross section, the collar 68 resembles a face-down E, whose spine 70, central fork 71, and outer forks 72 encompass each channel element 52 (defined by bight 74 and flanges 76, 77) of each swing arm 40, 42, while the central fork 78 passes diagonally downward through the lower central gap 62 of the swing arm. To the central fork 78 is fixed, as by welding, a generally level foot support base 80 which extends at least another 12 inches beyond the front of its associated swing arm 40, 42, where it supports a foot support pad 82. The collar 68 is guided up and down along the swing arm by opposed sets of guide wheels 84, 86 (FIG. 6) rotatably mounted inside each outer fork 72 and extending into a recess 88 defined by the bight 74 and flanges 76 of the channel elements 52. The guide wheels 84 are rollingly engaged with the forward flanges 76 and the guide wheels 86 are rollingly engaged with the rear flanges 77. A similar set of guide wheels 90 are rotatably mounted on the foot support base 80 and are rollingly engaged with the outer surface of the forward flanges 76. The guide wheels are widely staggered so as to stabilize the foot assembly and ensure a smooth ride up and down the swing arm.

Figure 7A:
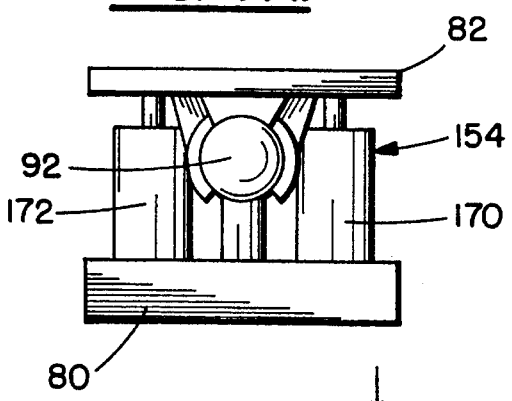
FIGS. 7A, 7B and 7C are detail front elevation views of components illustrated in FIGS. 1–4 and depicting different relative positions thereof.
Figure 7B:
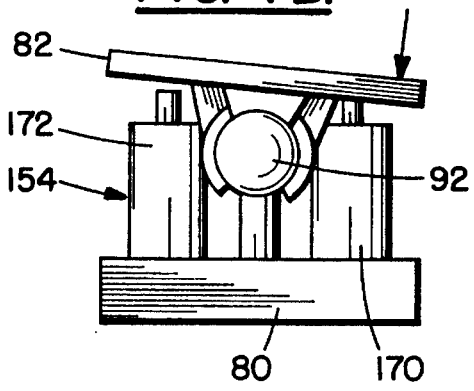
Figure 7C:
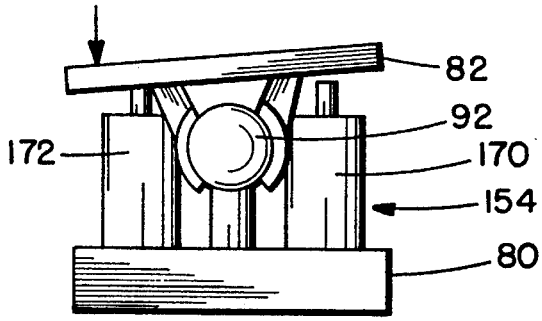
Figure 8:
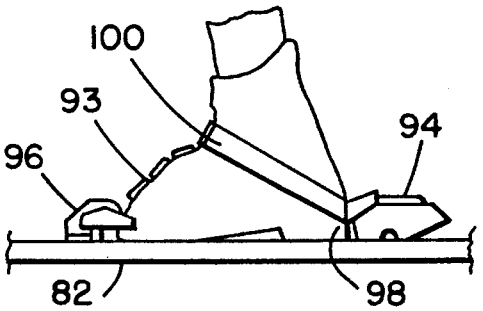
FIG. 8 is a detail side elevation view illustrating a ski boot and ski binding which may be used with the system of the invention.

The foot support pad 82 is mounted on the foot support base 80 by means of a ball joint 92 for substantially universal movement (see FIGS. 7A, 7B and 7C). The foot of the skier may be secured to the foot support pad by means of a boot 93 and/or a suitable ski binding mechanism 94 so as to hold a stockinged foot securely and provide proper ankle stability. Alternatively, although not shown, the securing device may resemble a modern snowboard binding or an old fashioned rollerskate binding which enables a conventional shoe or sneaker to be mounted with toe and heel pieces interlocking so as to permit length adjustment. As illustrated in FIG. 8, the foot of the skier is secured to the foot support pad by means of a toe cup 96, a heel piece 98, and an adjustable instep/ankle strap 100, so that the foot support pad 82 follows faithfully the movements of the skier.

A few inches of space behind the heel piece 98, that is, between it and the swing arm, ensure that the back and buttocks of the skier will not be in contact with the frame 34 or with the swing arms 40, 42 during the operation of the system 20.

Figure 9:
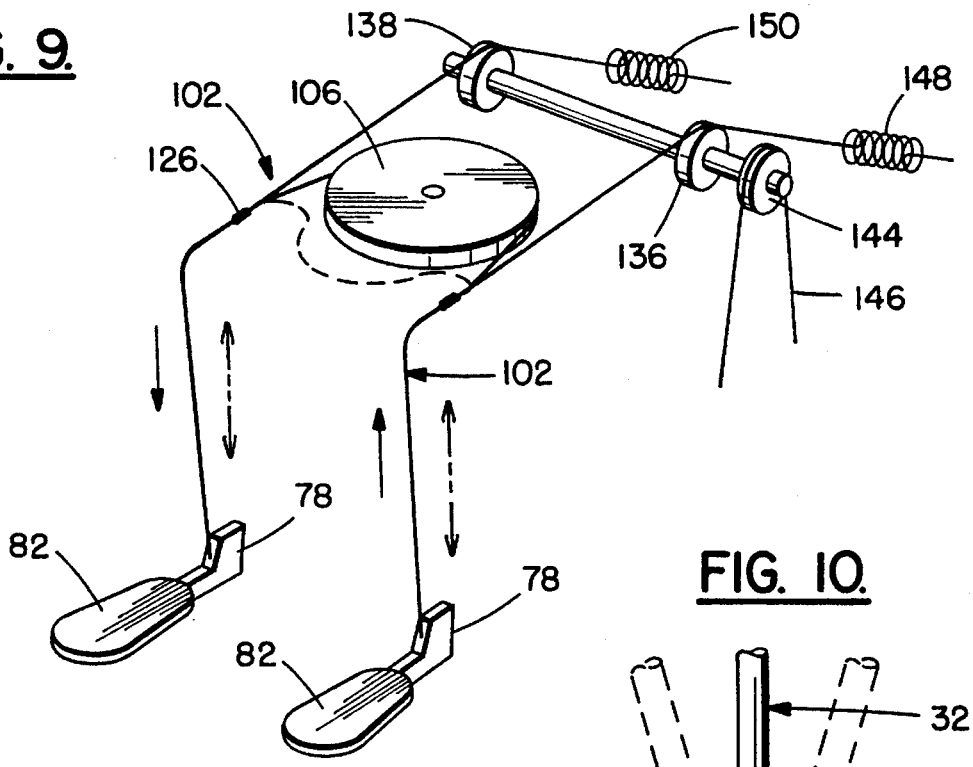
FIG. 9 is a diagrammatic perspective view illustrating some of the operative mechanism of the system of the invention.

Viewing especially FIGS. 1 and 9, the foot platforms 48, 50 are interconnected via a continuous elongate cable 102 which extends from the central fork 78 of each collar 68 up through the central gap 62 to the top of the associated swing arm 40, 42, where it is guided through the hollow swing pins 44 and over a small idler pulley 104 in each swing pin, then looped around a large horizontal intermediate pulley 106. The cable 102 enables an alternating, dependent, stepping movement of the two feet of the skier such that one leg flexes when the other extends. Leg extension is caused to terminate when bottom of the foot support base 80 becomes substantially flush with the transverse base member 64 of each swing arm. As previously mentioned, springs 66 are mounted on the transverse base members 64 and are aligned for engagement with the foot support bases 80 to ease the impact at the end of extension and to cause a rebound effect analogous to the recoil of a flexed (weighted) ski as it resumes its normal shape (camber) upon initial unweighting. Thus, the extension phase is followed naturally by flexion, with initiation of extension on the other side.

The system 20 provides for a suitable resistance to impede travel, respectively, of the left and right foot platforms between the upper and lower ends of the swing arms. A mechanism to provide this resistance will now be described. The frame 34 includes an integral cross beam 108 generally parallel to, and spaced rearwardly of, the upper cross bar 38. A forwardly extending support member 110 supports the intermediate pulley 106 in a cantilevered fashion for rotation on the frame 34 and has an elongated keyway 112 therein. A suitable fastener 114 has a head and a shank which extends away from the head and through the keyway 112 for threaded engagement with the frame. The head is engageable with the support member 110 for selectively immovably securing the support member to the frame 34.

The elongate cable 102 actually includes a left cable lead 120 joined at a first end to the foot support base 80 of the left foot platform 48, a right cable lead 122 joined at a first end to the right foot platform 50, and an intermediate cable lead 124 joining the left and right cable leads at suitable connectors 126. As noted previously, when the intermediate cable lead is wrapped around the intermediate pulley 106, cable movement is thereby transferred between the left cable lead and the right cable lead. Each of the left and right cable leads 120, 122 has a second end distant from the first end attached to the frame 34 at an aft cross beam 128.

A flywheel 130 is rotatably mounted on a flywheel shaft 132 suitably supported on the frame 34 for rotation on an axis which is spaced from and parallel to the plane containing the swing arms 40, 42. A flywheel pulley 134 coaxial with the flywheel is also mounted on the flywheel shaft for unitary rotation therewith. Left and right laterally spaced coaxial drag pulleys 136, 138 are mounted on a drag shaft 140 and extend between opposed forwardly extending brace members 142 on the frame 34. By reason of this construction, the drag pulleys 136, 138 are mounted for rotation on an axis spaced from and parallel to that of the flywheel shaft 132. The left drag pulley 136 is positioned so as to be frictionally engaged with the left cable lead 120 and the right drag pulley 138 is similarly frictionally engaged with the right cable lead 122. A flywheel idler pulley 144 is similarly mounted on the drag shaft 140 coaxially with the drag pulleys 136, 138 for rotation therewith. A drive belt 146 is mutually engaged with the flywheel idler pulley 144 and with the flywheel pulley 134 for imparting rotation to the flywheel 130 in response to rotation of the drag pulleys 136, 138.

With the left and right cable leads 120, 122 thereby engaged, respectively, with the drag pulleys 136, 138, resistance is thereby interposed to the foot platforms 48, 50 for impeding their travel between the upper and lower ends, respectively, of the left and right swing arms. The effectiveness of the engagement between the cable leads and the drag pulleys can be improved and even controlled by providing, in any suitable manner, drag springs 148,150 in series, respectively, with the cable leads 120, 122 for yieldably drawing the cable leads into frictional engagement with their associated drag pulleys. By altering the spring rate of the drag springs 148, 150, the resistance on the foot platforms 48, 50 can be changed, as desired.

Variation of the step amplitude is provided by adjustment of the horizontal intermediate pulley 106, which can be moved back and forth, towards and away from the plane of the swing arms 40, 42 in order to alter the length of the left and right cable leads 120, 122 between the foot platforms and the intermediate pulley. The longer the respective lengths of the left and right cable leads, the greater the step amplitude provided to the skier. A minimum step amplitude (for example, three to six inches) ensures that, during lateral extension, the extended outside leg will always remain below (that is, "downhill" from) the flexed inside leg, regardless of the stance or lateral position of the skier. As step amplitude increases (that is, to approximately 12 to 18 inches), so does the steepness of the gradient between the flexed "uphill" leg and the extended "downhill" leg. By way of example, the horizontal intermediate pulley 106 may require one inch of travel for every two inches of step amplitude. Thus, with nine inches of travel, variation of the step amplitude would be permitted in the range from zero to 18 inches.

The ball joints 92 allow substantially universal foot rotation, that is, rotation about three orthogonal axes. More specifically, the ball joint 92 on each foot platform 50, 52 pivotally mounts the foot support pad 82 for universal movement on the foot support base 80 through first and second ranges of motions, respectively, where the first range may be rotation about the longitudinal axis of the foot and where the second range may be rotation about the short axis of the foot. Rotation around the long axis of the skier's foot represents ski edging; rotation around the short axis of the foot allows heel elevation during leg flexion; and rotation around the long axis of the tibia represents rotary toe movements. The ball joint 92 is situated near the front of the foot support base 80, that is, approximately under the ball of the skier's foot, so that the normal heel position is down. Thus, the foot rests horizontally during weighted leg extension, but the heel piece 98 can be raised easily, as needed, to maintain a comfortable posture, during leg flexion or unweighting. The neutral position along the tibial axis of the leg of the skier is with the feet aligned parallel, that is, non-wedged, but the device will allow up to 60 degrees of rotary movement around this axis. Outward heel rotation will tend to occur naturally during lateral braking (see below), as when an edged ski is carving a turn. As on actual skis, these rotary forces can be resisted by the lateral calf and upper leg muscles in an effort to keep the feet relatively parallel, but the maximum extent of heel separation will be restricted so as to prevent ankle inversion injury. Attachment of a short imitation ski tip (not shown) extending in front of the foot may help guide the subject's rotary foot steering movements by providing visual feedback regarding foot alignment.

Rotation around the long axis of the foot simulates actual ski edging. This action activates a lateral brake mechanism 152 (FIG. 3) operable for arresting motion of the associated swing arm and an associated brake operating system 154, as follows. The brake mechanism 152 includes a U-shaped track member 156 fixed on the frame 34 mounted on and extending between the side pillars 36. The track member 156 has an elongated channel 158 lying in a plane parallel to the swing arms and narrowly spaced therefrom. A wheel follower 160 includes an axle 162 for rolling engagement with the track member 156 in the channel 158. A dancer arm 164 pivotally connects the associated swing arm to the axle. A brake shoe 166 in the channel is movable between a first position engaged with the wheel follower 160 and a second position disengaged from the wheel follower.

Figure 3:
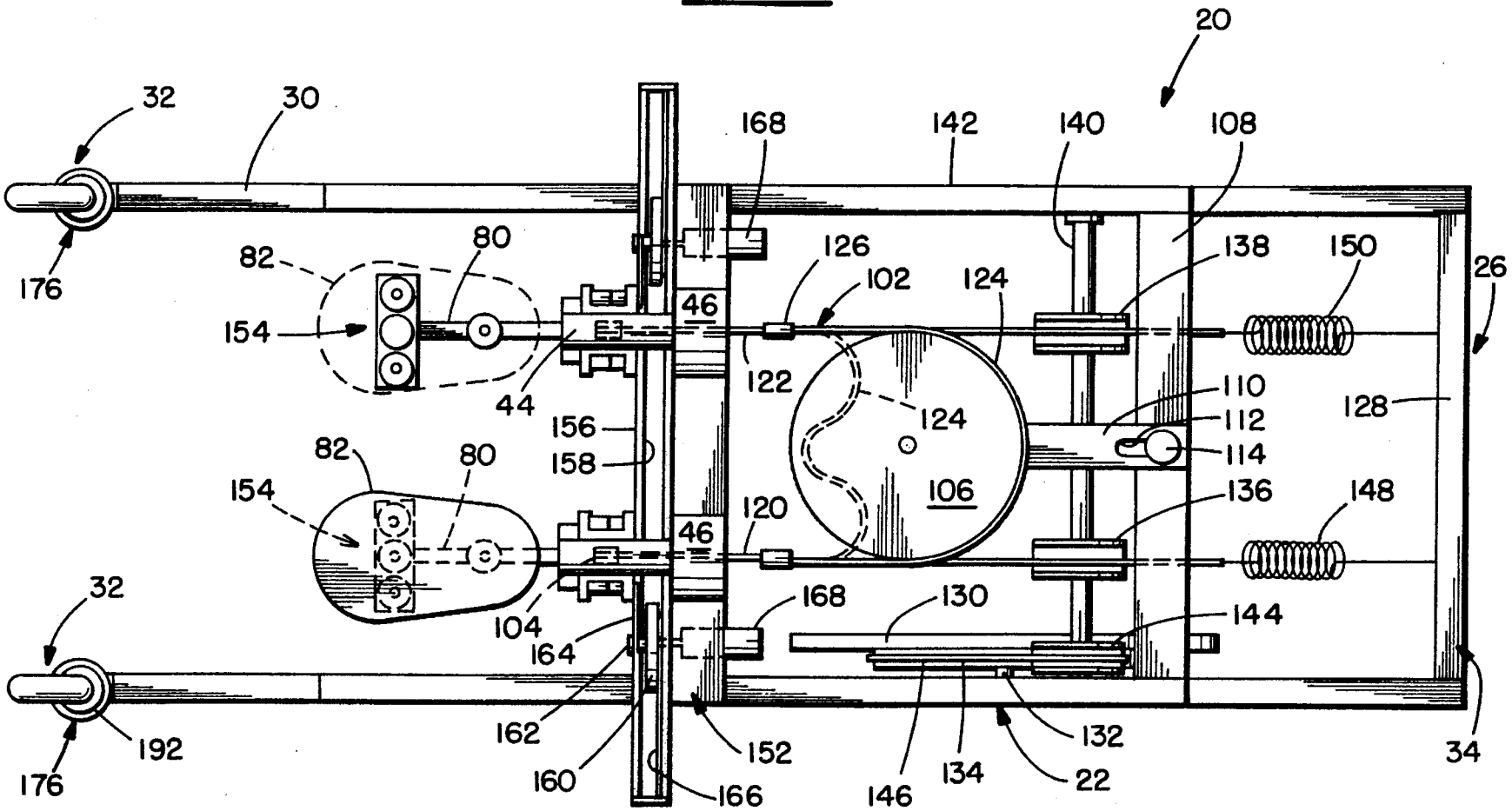
FIG. 3 is a top plan view of the skiing simulator system illustrated in FIGS. 1 and 2.
Figure 4:
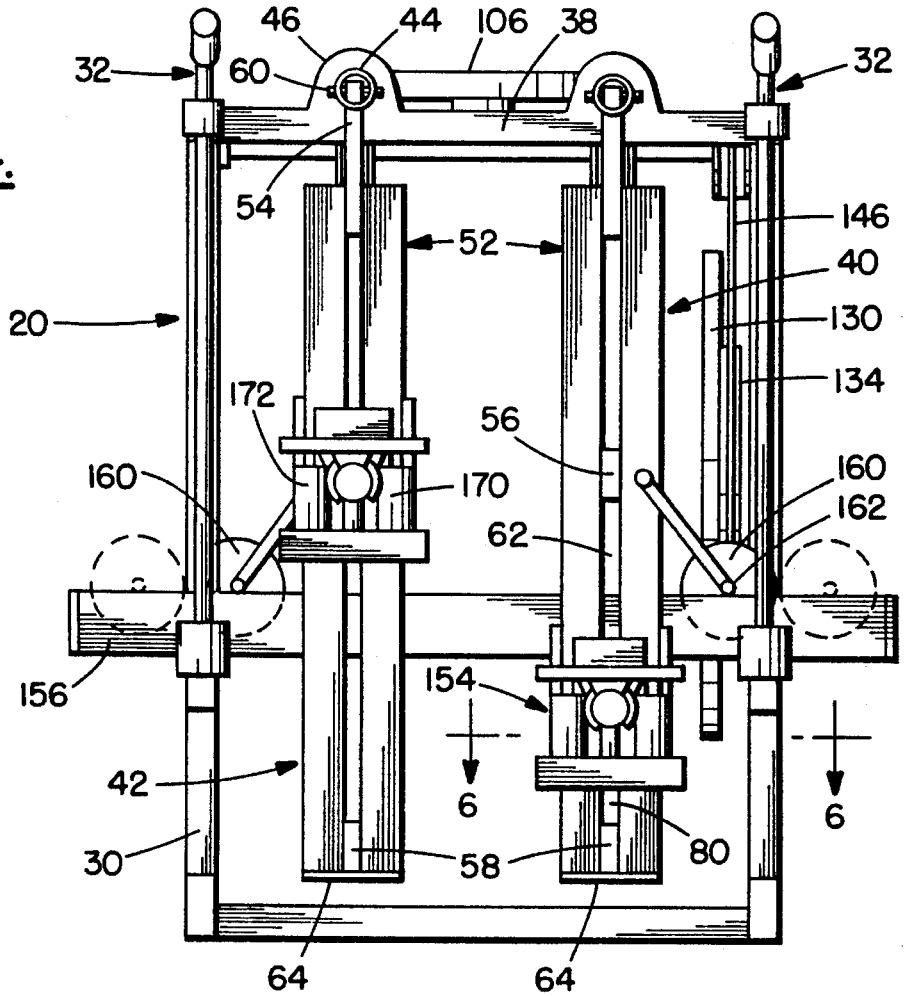
FIG. 4 is a front elevation view of the skiing simulator system illustrated in FIGS. 1–3.

The brake operating system 154 includes an actuator 168 suitably mounted on the frame 34 and responsive to the position of the foot support pad 82 to move the brake shoe between the first and second positions. The mechanism 154 also includes a detector array on the foot support base 80 comprising a pair of left and right lateral detectors 170, 172, respectively, (FIGS. 7A, 7B and 7C) spaced left and right from the ball joint 92 and a rear detector 174 (FIG. 3). The left and right lateral detectors are activated when engaged by the foot support pad 82 as it is rotated about the longitudinal axis of the skier's foot. The rear detector is likewise activated when engaged by the foot support pad as it is rotated about the lateral axis of the skier's foot.

TABLE 1

| | CONDITION OF BRAKE | | |
|---|---|---|---|
| | tilted left | neutral tilt | tilted right |
| heel up | OFF | OFF | OFF |
| heel down | ON | OFF | ON |

As seen in Table 1, the brake mechanism 152 is operated in response to the foot support pad 82 when the foot support pad moves through a first range of motions. Specifically, this occurs when, about its lateral axis, it assumes a neutral, or level, position activating the rear detector and such that, about its forward and aft axis it is pivoted to simultaneously engage and thereby activate either the left or right lateral detectors. The brake mechanism 152, however, is ineffective when the foot support pad moves through a second range of motions. Specifically, this occurs when, about its lateral axis, it assumes a forwardly tilted position (heel up) inactivating the rear detector regardless of its positioning about its forward and aft axis.

Thus, when the foot support pad assumes the first range of operating positions, the brake operating system 154 is operable to initiate and continue operation of the actuator 168 to move the brake shoe into engagement with the wheel follower 160. Edging motions will thus activate the brake since increasing degrees of foot rotation will progressively depress the brake shoe 166. The sensitivity of the brake may be adjustable. Because of the symmetrical nature of the detector array, similar braking may be accomplished either by inward or outward foot rotation, simulating edging of the outside ski and inside ski, respectively. In addition, the foot support pad 82 is sufficiently wide to permit consistent operation regardless of the rotary position of the foot. Restriction of the rear detector 174 to a location behind the ball joint 92 assures braking only under conditions of weighting (heel down), as on actual skis, while ensuring that the brake releases properly during unweighting (heel up), allowing a safe and unimpeded weight transfer.

The lateral brake mechanism is effected by frictional resistance applied to the wheel follower 160 mounted on the back surface of each swing arm 40, 42 by means of the outwardly oriented dancer arm 164 and tracking along the channel 158 in the track member 156. Upon brake actuation, the actuator 168 depresses the brake shoe 166, squeezing the wheel follower within the channel 158 of the track member 156. A stop member (not shown) at either end of the horizontal track member may be employed to prevent excessive lateral deviation. Also, the track member 156 will be wide enough to accommodate at least approximately five feet of lateral travel at the level of the skier's feet, but will be situated high enough along the swing arm 40, 42 that the lateral travel required of the wheel follower 160 will be substantially less than the lateral travel achieved by the skier's feet. By minimizing the travel of the wheel follower 160, a "high bar" position also insures that neither wheel follower will cross the midline, thus ensuring that the left and right leg brakes can always be activated independently.

A realistic braking mechanism would be activated by relatively little horizontal deviation of the foot. On the snow, a small amount of angulation of a weighted ski (i.e. <20 degrees from horizontal) places that ski on edge and allows it to flex, causing it to begin carving a turn and decelerating any lateral motion opposing that turn. Greater angulation will cause greater lateral deceleration, allowing the flexed ski to carve a narrow track without slipping or sliding. Extreme angulation (that is, >60 degrees from horizontal for a racer in a high speed turn) causes a well sharpened ski to hold its edge firmly despite forceful lateral leg extension. On a steeper hill, significantly less foot rotation is required to effect good edging, since the snow is already sloping away from a horizontal ski.

A characteristic of the above described brake design is that lateral arm swing causes intrinsic and progressive inward angulation of the outside foot base away from horizontal (prior to any active foot rotation relative to the swing arm), requiring additional inward angulation to initiate braking. Although a longer arm minimizes the degree of angulation occurring in a given lateral range, and thus the total angulation needed to activate the lateral brake, a construction for achieving earlier and easier brake activation may be desirable. Toward this end, consider the following. A passive lateral resistance profile with resistance proportional to the extent of lateral deviation and the associated foot angulation would be consistent with the braking (edging) effects that normally result from such angulation on the snow. Passive lateral resistance must be unidirectional, decelerating motion away from but not toward the midline, the latter action normally being unimpeded since ski unweighting causes prompt edge release. Such an action could be produced by an elastic cable (of variable length and tension) extending from the center of the exercise deck to the bottom of each swing arm.

A means of reducing intrinsic inward foot rotation during lateral deviation would also allow earlier lateral brake activation. This could be accomplished by a dynamic mechanism (for example, by a parallelogram linkage) whereby the foot support pad 82 is caused to rotate with respect to the swing arm 40, 42 (at its juncture with the central fork 78) during the course of lateral swing, such that the neutral (unbraked) position of the foot support pad remains horizontal throughout travel through the lateral range.

Mogul skiing requires tandem leg flexion and extension in an oscillating fashion, akin to hopping rather than stepping. The oscillation is provided by the drag springs 148, 150 adjacent the aft cross beam 128. The hopping exercise can be performed by removing the intermediate cable lead 124 (FIG. 3) from the intermediate pulley 106 enabling both feet of the skier to rise together to an up position. In this regard, when both feet are in the up (flexed) position, the drag springs 148, 150 remain coiled. When both feet are lowered by gravity to a down (extended) position, the drag springs 148, 150 are cause to uncoil and extend. When the springs 148, 150 recoil, the feet of the skier return to the up (flexed) position, and so on. In order to achieve a maximum hopping amplitude of at least 2 feet, the frame 34 must accommodate an equivalent displacement of the cable 102 beginning from its zero position, that is, both feet fully extended and moving away from the aft cross beam 128. The hopping resistance and amplitude can be varied by adjusting the spring rate of the drag springs 148, 150 and the length of the cable 102. An independent hopping mode can be achieved by connecting the cable from each foot platform to a separate spring.

Figure 10:
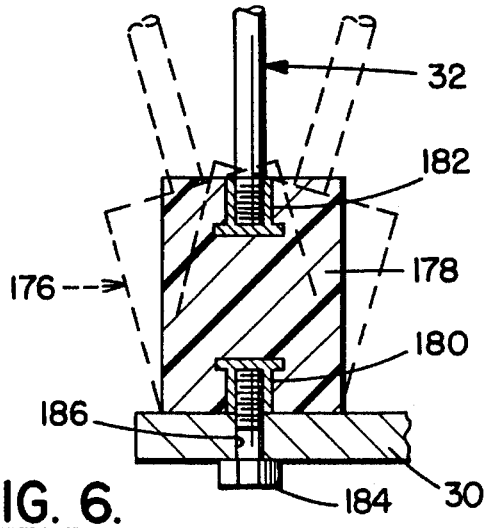
FIG. 10 is a detail side elevation view, certain parts being shown in section for clarity illustrating components also illustrated in FIGS. 1–4 and indicating a range of positions thereof.

As previously mentioned, the system 20 is fitted with hinged poles 32 mounted at the front of the frame 34. The pole height, separation and position are preferably adjustable although, for simplicity, such a construction is not illustrated. The poles must be situated far enough in front of the feet of the skier to assure that the hands of the skier can assume a range of comfortable skiing positions (that is, up to 24 inches in front of the skier's body) and so that contact during knee flexion is avoided. An inward mounting angle or curvature of the poles would meet the likely need for greater minimum clearance at the knee level than at the hand level, and may also help accommodate small imitation ski tips. The poles are preferably attached to the frame 34 by means of a universal hinge 176. In a preferred construction, the universal hinge may be a cylindrical elastomeric member 178 fixed to and extending between an extremity of each of the extension members 30 and the foot end of the ski pole 32. For example, as seen in FIG. 10, a pair of opposed nut members 180, 182 may be embedded in the elastomeric member 178. At its lower end, a bolt 184 may extend through a suitably located hole 186 in the extension member 30 for threaded engagement with the nut member 80. At its upper end, the lower end of the ski pole 32 may be threaded for engagement with the nut member 182. With this construction, it can be seen that the ski pole 32 is movable through a wide range as indicated by the dashed lines in FIG. 9.

Alternately, a simple hinge (not shown) allowing side-to-side travel might be sufficient (given the multifaceted adjustability of the poles), and may aid the balance of the skier by providing greater fore-aft stability of the upper body.

Additionally, a second universal hinge 192 may be provided below a grip 194 to permit the skier to maintain a realistic outward hand orientation throughout the exercise. Resistance to lateral pole swing can be passive (i.e. heavy rubber collar surrounding the base of the grip 194) or active. Active resistance may be provided by an adjustable handgrip brake (not shown) capable of freezing pole motion. Use of such a brake to simulate a resistive pole plant would involve the upper upper body of the skier in the exercise and assist the skier with balance and weight transfer.

Operation of the Invention

A skier using the system 20 will mount the device as if getting on a step machine backwards, facing away from the hardware in order to avoid knee contact during leg flexion. Inexperienced subjects will need supervision to ensure a safe and beneficial exercise. The pole height and position should be adjusted so that the upper body is erect with the hands comfortably in front in a natural skiing position. To prevent slippage, the shoes will have to be secured prior to the exercise.

Novices: As they do on the mountain, first time "skiers" may need to begin with assessment of two-legged and one-legged balance using simple midline hopping and stepping maneuvers on the device. These exercises introduce the student to the lateral and fore-aft stability requirements of the straight run and walking on skis.

Figure 11:
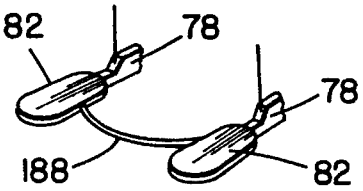
FIG. 11 is a detail perspective view illustrating another embodiment of the invention.

Next, novices will need to learn stance control by standing up with both legs evenly weighted in a closed position. They can now open their stance to a wedge position and then close it again. Repetition of this maneuver will simulate a snowplow technique. For this exercise, an adjustable elastic band removably linking the bottoms of the swing arms 40, 42, or foot support pads 82, as illustrated in FIG. 11, may be used to resist the open stance, thus training of the hip adductor muscles as well as the abductors, and preventing excessive leg separation (and hence groin injury). Bilateral inward foot rotation may occur, but the lateral brake should be disengaged for this exercise because, in the absence of left-to-right weight transfer, there is no means of effecting safe brake release.

Beginners: Beginner level skiers will begin lateral stepping exercises with a minimum of lateral and vertical motion and with a wide stance, so as not to lose their balance. They will experience alternating lateral leg extension, transferring weight from side-to-side, preferentially weighting one leg at a time. The legs can be fixed apart for lower level students, or swing freely for those who are ready to experiment with edge control, enabling weight transfer from a moving leg.

The fixed apart position permits a good deal of force generation with maximum stability. This basically represents a modified step machine with a wide stance. Compared to ordinary (closed stance) stepping, which primarily works the hip extensors (i.e. gluteus maximus), central quadriceps and calf muscles, wide stance or lateral stepping will provide extra training for the hip abductor muscles (i.e. gluteus medius) and lateral thigh and calf structures, which are critical for skiing.

The free swing mode will permit side-to-side motion with an open stance, testing the beginner's balance and stance control. The lateral brake can now be introduced, enabling deceleration of the lateral motion of the outside leg via inward foot rotation, in order to control the weight transfer. This exercise simulates wedge turns, since actual skis are designed to flex and thereby carve a turn when they are placed on edge and this type of lateral weighting is applied. This simulated edging can be accomplished by lowering the center of gravity (i.e. pelvis) medial to the extended outside leg, such that the long axis of the leg falls below the long axis of the swing arms 40, 42, causing inward rotation of the foot platforms 48, 50, activating the lateral brake mechanism 152. As in skiing, this position requires hip angulation in order to maintain an upright upper body. A degree of ankle eversion also can be employed to effect inward rotation of the foot platform.

Figure 12:
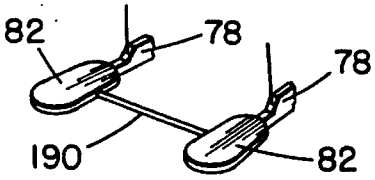
FIG. 12 is a detail perspective view illustrating still another embodiment of the invention.

An introductory lateral motion exercise would be with both feet in the down position (zero step amplitude). Until stance control is mastered, a rigid spacer bar 190 (FIG. 12) could be removably secured between the swing arms to fix the foot separation during the side-to-side motion (much like the tip separators sometimes used for beginning skiers to keep their tips from crossing on the mountain). This represents a unique lateral swinging exercise. With practice, the spacer bar can be weaned, and the lateral range and step amplitude can be progressively increased until a vigorous open stance lateral stepping exercise is achieved. No prior art device known to the inventors has permitted these diverse ski-specific exercises for beginners.

Intermediate: Skiers with a little experience and a better sense of balance will begin to experiment with a closed stance. Toward the end of extension, with the extended leg stabilized by means of the lateral brake, they will allow their flexed inside (uphill) leg briefly to come in towards the extended outside (downhill) leg. They will quickly open their stance again in preparation for weight transfer to the other leg. This exercise simulates wedge christie. As subjects gain confidence, they will be able to maintain a closed stance for more of each extension cycle, using the open stance primarily for the weight transfer. This is analogous to stem christie. Combinations of open and closed stances will require realistic rotary foot movements to keep the feet properly aligned.

Advanced: Better skiers will be able to maintain a closed stance throughout the exercise, as in parallel skiing. These skiers will enjoy experimenting with a variety of device settings. A relatively high resistance to stepping will require more force generation and create a pattern of wide, slow turns. Alternately, a low resistance to stepping can be used to permit shorter, quicker turns. By making subtle adjustments of lateral position and stance, force and quickness, better skiers will be able to explore their sense of balance, strength and technique, as they do when they cruise the mountain. Vigorous poling will provide substantial upper body exercise.

Progression from an open stance to a closed stance changes the orientation of the inside ski. In an open (wedge) position, lateral stabilization of both legs can be accomplished by inward foot rotation. In the closed (parallel) stance, edging of the inside leg requires outward rather than inward foot rotation, which can also be linked to the braking mechanism. Although edging of the outside (downhill) leg is more essential to the exercise, simultaneous operation of the inside (uphill) leg brake will permit a more even (and realistic) distribution of weighting and edging actions between both legs, providing more realistic simulation of parallel skiing.

Expert: Expert skiers using the system 20 will explore the performance limits of the device and their own ability. They will generate large vertical and lateral forces and they will cover an extreme lateral range with marked hip angulation. They will want to maximize the step amplitude to experience the feel of steeper terrain and a more athletic skiing style. This dynamic vertical and lateral exercise will demand a high degree of balance, coordination and strength. At high resistance to stepping, they will make wide, forceful turns as in giant slalom. At low resistance, they will make quick turns as in slalom and mogul skiing.

To allow the quickest weight transfers, it may be necessary to engage a vertical brake (not shown) in tandem with the lateral brake. Vertical braking could be accomplished in tandem with lateral braking by a drag means mounted on the foot platforms 48, 50 and applied along the swing arms 40, 42. Without the vertical brake, a totally stable platform for weight transfer is achieved only at the end of extension. In this mode, the lateral brake can be activated at any point during outward leg extension, but extension will continue and weight transfer will not be possible until the extension phase has been completed. This situation will reproduce the sensation of riding an edge during the carving of a long, rounded turn. However, the inherent delay in extension may limit the frequency of turning, especially at relatively high step resistance. In reality, good skiers are able to accomplish the weight transfer earlier, at any stage of extension, in order to produce the quickest turns. With the dual brake, voluntary weight transfer at any phase of lateral extension will be possible, adding a further dimension of realism to the exercise.

In order to terminate the exercise or to recover from a loss of rhythm or balance, skiers can assume an evenly weighted wide stance and, reproducing a wedge stop, use bilateral inward foot rotation to activate both left and right brakes simultaneously. As a result, the lateral and vertical motion of both legs can be decelerated rapidly and safely. Both swing arms can then be eased toward the midline position, permitting the skier to dismount the system 20.

Various advanced ski techniques can be performed on the system 20. Step christie, a racing technique consisting of a deliberate lateral or uphill step performed during weight transfer in order to achieve a higher line of descent, can be simulated as a result of our independent leg action. Turning from the uphill ski, a safety technique for extremely steep terrain, could be simulated by outward rotation of the flexed inside leg to engage the lateral and vertical brake (as when the uphill ski is placed on edge), creating the possibility of weight transfer from the flexed inside leg.

During parallel brake operation, as discussed above, it will be essential that the outwardly rotated inside foot release easily during weight transfer, permitting that leg to be moved promptly across the midline, ahead of the shifting center of gravity, and permitting assumption of a wide safety stance whenever necessary. The brake release may be made more sensitive by positioning the rear detector 174 at the more posterior portions of the foot, so that heel elevation (unweighting) leads to prompt release of the brake mechanism 152.

Mogul Skiing Variation

The tandem flexion/extension (hopping) exercise for mogul simulation can be selected by lengthening the blind loop (raising both feet and attaching it to the hopping cable, as described above. Now, with both feet in the up position, the system 20 can be mounted carefully and the shoes can be strapped in (one leg at a time, holding on to the poles). The weight of the subject will cause the feet to lower somewhat. An initial up motion may have to be initiated with a jumping action aided by pushing down on the poles, as in a ski racing start. This is followed by a weighted down motion (with legs extended), stretching the springs, which then recoil, causing a passive up motion simulating the rising terrain of an oncoming mogul. Now, active leg flexion (as in a squat jump), stabilized by downward hand pressure, will allow the subject to absorb and complete this upmotion while maintaining a steady upper body position. Up flexion is again followed by down extension, and so on.

Mogul Beginner: Skiers will first attempt a purely vertical exercise in order to get accustomed to the hopping motion and the yo-yo effect, just as mogul skiing is introduced on the mountain, where beginning mogul skiers must first traverse sideways across a mogulfield, without turning, to practice using tandem leg flexion and extension to smooth out the bumps. Vertical amplitude and resistance can be varied to reproduce moguls of varying size and contour.

Mogul Intermediate: Skiers who are comfortable with the vertical hopping action will begin to introduce lateral motion, simulating the turns needed to control their speed as they head downhill through a mogulfield. The lateral brake will remain in effect to permit controlled weight transfer. Learning skiers will probably use a somewhat open stance at times (i.e. to stabilize their landing during extension), until they master the exercise. In this respect, the device will be more forgiving than the mountain itself, where mogul students inevitably bounce and crash as they lose their rhythm or balance or let their legs get separated in a mogulfield.

Mogul Advanced: Accomplished mogul skiers will be able to practice combining their vertical and side-to-side movements with a closed stance, as required for a smooth run through the bumps. This lateral hopping motion will mimic mogul skiing in way that has never been accomplished off the slopes. The rapid, repetitive exercise will also provide an intense workout, helping the skier to achieve the high degree of strength and endurance needed to maintain rhythm and balance in a mogulfield.

Variations and Additional Applications

The system 20 has numerous adjustable features. Optimal settings will be determined by trial and error and will vary from subject to subject. Features that can adjusted before but not during the exercise include the pole height, position and separation; binding fit; arm swing mode (fixed or free); elastic and nonelastic stance spacer placement; vertical motion mode (stepping, hopping, or independent); maximum lateral range; maximum vertical stepping or hopping amplitude; passive vertical and lateral resistance profiles; maximum range of foot rotation; the lateral, vertical and handgrip brake sensitivity. Features that can be varied during the exercise include the vertical and lateral position and stance, yielding an unlimited variety of lateral stepping and hopping patterns; triaxial foot orientation; and the brake-activated resistance to lateral and vertical leg motion and pole motion.

Figure 13A:
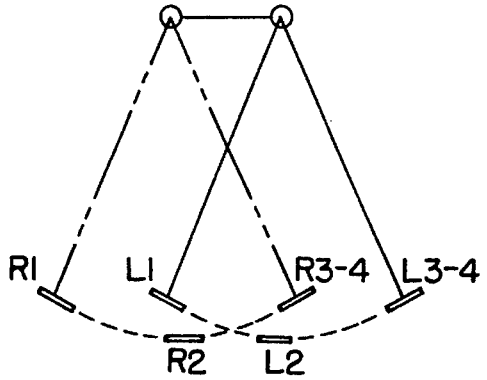
FIGS. 13A–13G are diagrammatic views which illustrated a variety of movements which can be achieved by a skier utilizing the system of the invention, which movements simulate actual skiing movements.

The nature and variety of the various lateral stepping patterns and their relevance to the emulation of various ski techniques and slope conditions need further clarification. Three parameters are particularly important, namely stance, lateral range and step amplitude. FIGS. 13A through 13G illustrate the spectrum of overlapping arcs described by the feet during lateral stepping exercises at various settings of lateral range, step height and stance. In the ensuing description, dimensions are approximations and are provided only for purposes of explanation and are not to be considered as limiting of the invention. FIG. 13A shows the pattern produced by a lateral range of 48", step height 6" and closed stance (10" from foot center to foot center). Right foot position is denoted by R, and left foot position is denoted by L. The subscript number denotes time, in sequence. T1 denotes right leg extended, corresponding the end of a left turn. T2 denotes the weight transfer phase, representing the transition between the left and right turn. T3 denotes the left leg extension phase, corresponding to the beginning of the right turn. T4 denotes full left leg extension, representing the end of a right turn. The midpoint of the turn is not depicted in these drawings.

Figure 13B:
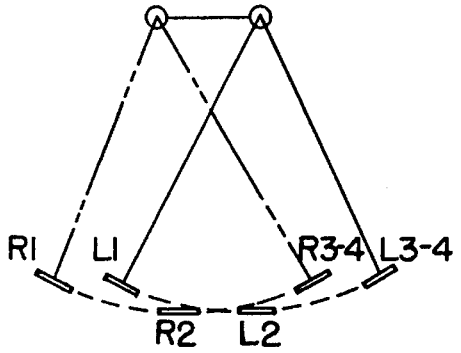
Figure 13C:
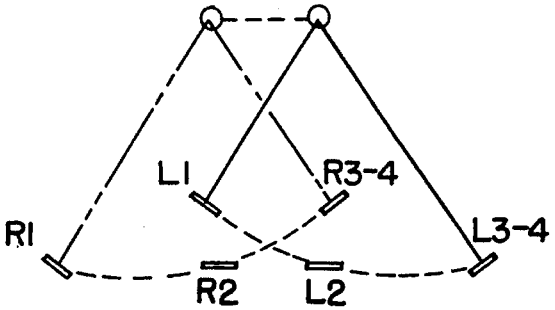
Figure 13D:
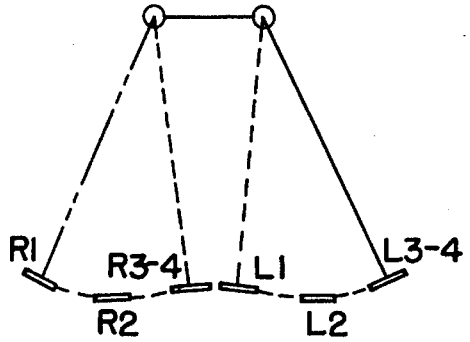
Figure 13E:
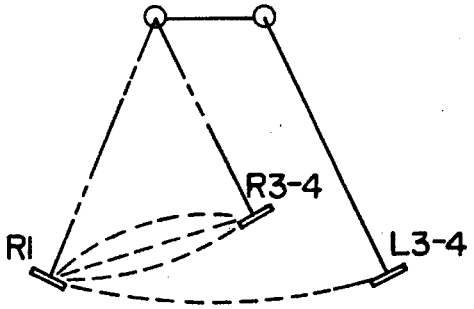
Figure 13F:
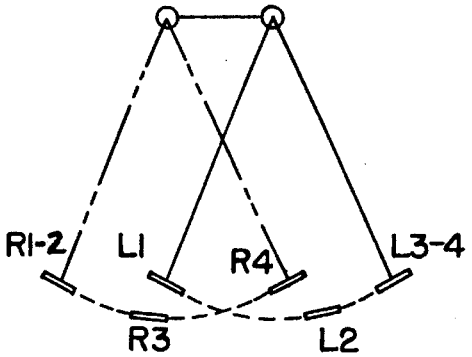
Figure 13G:
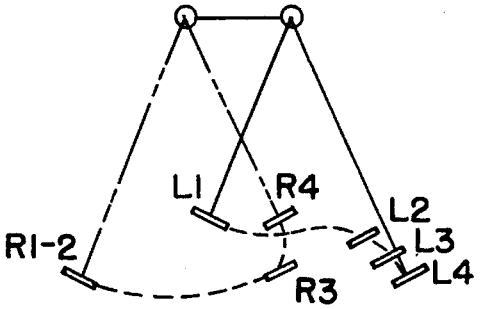

FIG. 13B demonstrates the modification of the arcs of foot travel resulting from a decrease in step height from 6 to 3 inches, with lateral range and stance unchanged from FIG. 13A. FIG. 13C illustrates the pattern generated by an increase in the lateral range from 48 to 60 inches, with the other two parameters unchanged from FIG. 13A. FIG. 13D shows the same lateral range and step height as FIG. 13A, but with a constant open stance of about 24 inches. Because of the wide stance, these arcs have less overlap. FIGS. 13F and 13G show patterns resulting from a mixture of open and closed stances (discussed further below). FIG. 13E shows the same three settings as FIG. 13A, but introduces a fourth element, the variable timing or slope of simultaneous lateral and vertical motion. This Figure illustrates that in addition to the unlimited permutations of lateral range, step height and stance, the variety of spatial patterns remains unlimited at every given lateral range, step height and stance.

Variable lateral range addresses the need to reproduce turns of varying radius. A larger lateral deviation will correspond to a longer radius turn. In general, turning frequency will be inversely related to turn radius (at a given level of resistance and force application), but more skilled and aggressive skiers will be able to maintain a higher turning frequency at a given radius. A high step resistance will also prolong the duration of leg extension and simulate a longer radius turn. Variable step amplitude addresses the need to simulate varying terrain steepness and skiing styles. A higher step amplitude correlates with a steeper ski slope and a more athletic style. Stance is the parameter that addresses emulation of the spectrum of ski turning techniques. This relationship is summarized in the following table, which describes the various turning techniques according to the temporal changes in stance.

TABLE 2

SPECTRUM OF SKI TURNING TECHNIQUES BY SEQUENTIAL CHANGES IN STANCE

| TURN PHASE | WEIGHT TRANSFER | BEGINNING OF TURN | MIDDLE OF TURN | END OF TURN |
|---|---|---|---|---|
| TIME POINT IN FIGURES | T2 | T3 | | T4 T1 |
| SKILLS | | | | |
| Wedge Turn | / \ | / \ | / \ | / \ |
| Wedge Christie | / \ | / \ | / \ | \| \| |
| Stem Christie | / \ | / \ | \| \| | \| \| |
| Parallel | \| \| | \| \| | \| \| | \| \| |
| Parallel with edge set | \| \| | \| \| | \| \| | / \ |
| Step Christie | \| \| | \| \| | \| \| | \| \| |

SYMBOLS:
1 \ and | | denote OPEN stances; | | denotes closed stance.

This entire spectrum of skills can be learned and practiced on the device by variation of stance, as shown in Table 2. Wedge turns result from maintenance of an open stance throughout the turn (illustrated in FIG. 13D). Parallel turns are achieved using a consistently closed stance (illustrated in FIGS. 13A, 13B & 13C). The stance for parallel skiing can vary from a very narrow track to a slightly wider track for better balance (for less experienced skiers or in more difficult snow conditions i.e. crud snow or heavy powder). The remaining skills result from combinations of open and closed stances. Advancement from wedge turns through wedge christie and stem christie to parallel skiing reflects the ability to spend progressively less time in an open stance. Parallel with edge set and step christie are variations on classic parallel. The skills involving a mixture of open and closed stances correspond to some relatively complex spatial arcs. Stem christie is diagrammatically illustrated in FIG. 13F and step christie is diagrammatically illustrated in FIG. 13G.

Various lateral and vertical forces will be generated by the subject during simulated skiing. Ergometry may be used to assess the athlete's strength and performance. Measurement of the forces generated along the long axis of the extended leg, representing edging and carving forces, would be particularly useful to skiers and racers and to their instructors and coaches. A means of measuring force generation along this vector would be via the contact springs 66 at the bottom of the swing arms 40, 42. Calibration of the spring would permit assessment of force generation from the extent of maximum spring compression during leg extension.

It will be understood by those skilled in the art that numerous variations and modifications, in addition to those already described, may be made in the invention without departing from the spirit and scope thereof.

For example, the lateral stepping exercises described herein and illustrated in FIGS. 13A through 13G could be reproduced by means other than the preferred embodiment described above. Virtually identical exercises could be produced by altering the design such that, instead of being suspended from above on a swing arm, each foot platform could be supported from below by a curvilinear, that is, concave, base track upon which they could roll side-to-side independently like two trolleys, each fitted with a hinged step capable of rising at the heel. The lateral stepping exercise (i.e. alternating flexion/extension) would be preserved by linking the heel of each hinged step to the previously described cables and transmission, or a simple cable passing over a single raised pulley. This alternate design achieves the same unlimited variety of lateral stepping patterns and full spectrum of skiing skills as described in the preferred embodiment. In addition, the design has some unique characteristics. First, if the track were made less steep (i.e. increase track radius without raising center points), the resulting step profile becomes non-linear, whereas the original design entails a constant step height during a given uninterrupted exercise (in the absence of vertical braking), due to the circular nature of the arc described by each swing arm. Specifically, such a design would cause the step height to vary with the lateral displacement. As the lateral travel increases, the distance from foot to cable pulley lengthens, so the step height must also increase. This variation would allow a subject to warm up with a modest lateral range and step height then, when ready, to progress to higher lateral and vertical displacements without dismounting the machine. In addition, use of a base track would permit some curvature in the fore-aft plane, i.e. lateral position forward versus center position back, which would add an additional degree of freedom with some relevance to free skiing.

A similar but even simpler design for lateral stepping would be a biphasic base track, with two adjacent concave arcs, placing each foot trolley in its own fixed arc. If each arc allows at least two feet of lateral range, a total lateral range of at least four feet would be achieved. This biconcave design would cause some inherent vertical motion (i.e. flexion of the inside leg as it approaches the rising center of the track), so the hinge and cable mechanism could be omitted, although the variety of lateral stepping patterns would be markedly restricted. The two legs can travel in their fixed arcs independently, but without overlapping. These arcs closely resemble those produced by lateral stepping exercise with an open stance (FIG. 13D), and preserves several useful exercises for beginning and intermediate skiers. Side-to-side motion with an open stance would simulate wedge turns. A closed stance remains possible during weight transfer, but the stance must open again at the end of lateral extension, due to the inability of either foot to cross the midline, so narrow track parallel skiing could not be simulated on this degenerate variation of the invention. However, the freedom to temporarily close stance around the time of weight transfer is sufficient to encompass exercises simulating wedge christie and step christie. To preserve voluntary weight transfer, inward foot rotation could be used to engage a brake mechanism, such as a direct frictional brake in contact with the base track. Elastic bands could be used to passively resist the lateral motion and prevent jarring impact at the lateral ends of the device.

While preferred embodiments of the present invention have been disclosed in detail, it should be understood by those skilled in the art that various other modifications may be made to the illustrated embodiments without departing from the scope of the invention as described in the specification and defined in the appended claims.

What is claimed is:

1. An exercise system enabling ski simulation comprising:

a frame;

a generally upright left swing arm extending between upper and lower ends being pivotally mounted on said frame at said upper end with said lower end of said left swing arm being free to swing through a first arc resulting in both lateral and elevational travel of said lower end;

a generally upright right swing arm extending between upper and lower ends being pivotally mounted on said frame at said upper end at a location on said frame laterally spaced from said left swing arm, said lower end of said right swing arm being free to swing through a second arc which is coplanar with the first arc resulting in both lateral and elevational travel of said lower end;

a left foot platform adapted to receive the left foot of a subject and mounted on said left swing arm and being adapted for elevational travel therealong as imparted by the subject between said upper and lower ends;

a right foot platform adapted to receive the right foot of a subject and mounted on said right swing arm and being adapted for elevational travel therealong as imparted by the subject between said upper and lower ends;

said left foot platform and said right foot platform being interconnected enabling the subject whose feet are received thereon to selectively cause said left foot platform and said right foot platform to travel elevationally and said left swing arm and said right swing arm to travel through the first and second arcs, respectively, to thereby perform a series of successive stances and movements both laterally and elevationally which simulate a skiing run.

2. A skiing simulator system as set forth in claim 1 including:

left attachment means for releasably securing the left foot of the user to said left foot platform; and right attachment means for releasably securing the right foot of the user to said right foot platform.

3. A skiing simulator system as set forth in claim 2:

wherein each of said attachment means includes a ski boot to receive a foot of the subject and a ski binding for securing said ski boot to an associated one of said foot platforms.

4. A skiing simulator system as set forth in claim 1 including:

operating means interconnecting said left and right foot platforms and said frame for causing stepping travel of said foot platforms such that left leg extension by the subject imparting downward force on said left foot platform moves said left foot platform toward said lower end and simultaneously moves said right foot platform toward said upper end and such that right leg extension by the subject imparting downward force on said right foot platform moves said right foot platform toward said lower end and simultaneously moves said left foot platform toward said upper end.

5. A skiing simulator system as set forth in claim 1 including:

operating means interconnecting said left and right foot platforms and said frame for causing hopping travel of said foot platforms such that simultaneous extension of both legs by the subject followed by simultaneous flexion of both legs by the subject cause seriatim simultaneous travel of said left foot platform and of said right foot platform toward said lower end, then simultaneous travel of said left foot platform and of said right foot platform toward said upper end.

6. A skiing simulator system as set forth in claim 4:

wherein said operating means includes:

an elongate cable having a left cable lead joined at a first end thereof to said left foot platform and a right cable lead joined at a first end thereof to said right foot platform, and an intermediate cable lead joining said left and right cable leads;

an intermediate pulley rotatably mounted on said frame and engageable with said intermediate cable lead for transferring cable movement between said left cable lead and said right cable lead; and left and right guide pulleys for guiding said elongate cable, respectively, from said left foot platform to said intermediate pulley and from said right foot platform to said intermediate pulley.

7. A skiing simulator system as set forth in claim 6:

wherein said operating means includes:

resistance means for impeding travel of said left foot platform and of said right foot platform between said upper and lower ends, respectively, of said left swing arm and of said right swing arm.

8. A skiing simulator system as set forth in claim 7:

wherein said left and right swing arms lie in a first plane;

wherein said intermediate pulley lies in a second plane perpendicular to said first plane;

wherein said left cable lead has a second end distant from said first end and attached to said frame;

wherein said right cable lead has a second end distant from said first end and attached to said frame;

wherein said resistance means includes:

a flywheel mounted on said frame for rotation on an axis spaced from and parallel to said first and second planes;

a flywheel pulley coaxial with said flywheel mounted for unitary rotation therewith;

left and right laterally spaced coaxial drag pulleys mounted on said frame for rotation on an axis spaced from and parallel to said first and second planes, said left drag pulley being frictionally engaged with said left cable lead, said right drag pulley being frictionally engaged with said right cable lead;

a flywheel idler pulley mounted on said frame coaxially with said drag pulley for rotation therewith; and a drive belt mutually engaged with said flywheel idler pulley and with said flywheel pulley for rotation of said flywheel in response to rotation of said drag pulleys.

9. A skiing simulator system as set forth in claim 6 including:

adjustment means for selectively adjusting the range of elevational travel of said left foot platform and of said right foot platform.

10. A skiing simulator system as set forth in claim 6 including:

a support member supporting said intermediate pulley for rotation thereon, said support member having an elongated keyway therein; and a fastener having a head and threaded shank extending away from said head and through the keyway for threaded engagement with said frame, said head being engageable with said support member for selectively immovably securing said support member to said frame.

11. A skiing simulator system as set forth in claim 7 including:

first resilient means for yieldably drawing said left cable lead into frictional engagement with said left drag pulley; and second resilient means for yieldably drawing said right cable lead into frictional engagement with said right drag pulley.

12. A skiing simulator system as set forth in claim 1 wherein:

each of said swing arms includes a transverse base member at said lower end; and a resilient stop member mounted on said base member engageable by said associated foot platform as said foot platform approaches said lower end to thereby absorb the impact and induce rebound.

13. A skiing simulator system as set forth in claim 5:

wherein said operating means includes:

a left cable lead joined at a first end thereof to said left foot platform and at a second end thereof to said frame;

a right cable lead joined at a first end thereof to said right foot platform and at a second end thereof to said frame; and a left guide pulley for guiding said left cable lead from said left foot platform to said frame for attachment thereto; and a right guide pulley for guiding said right cable lead from said right foot platform to said frame for attachment thereto.

14. A skiing simulator system as set forth in claim 13:

wherein said operating means includes:

resistance means for impeding travel of said left foot platform and of said right foot platform between said upper and lower ends, respectively, of said left swing arm and of said right swing arm.

15. A skiing simulator system as set forth in claim 7:

wherein said left and right swing arms lie in a first plane;

wherein said resistance means includes:

a flywheel mounted on said frame for rotation on an axis spaced from and parallel to said first plane;

a flywheel pulley coaxial with said flywheel mounted for unitary rotation therewith;

left and right laterally spaced coaxial drag pulleys mounted on said frame for rotation on an axis spaced from and parallel to said first plane, said left drag pulley being frictionally engaged with said left cable lead, said right drag pulley being frictionally engaged with said right cable lead;

a flywheel idler pulley mounted on said frame coaxially with said drag pulley for rotation therewith; and a drive belt mutually engaged with said flywheel idler pulley and with said flywheel pulley for rotation of said flywheel in response to rotation of said drag pulleys.

16. A skiing simulator system as set forth in claim 14 including:

first resilient means for biasing said left foot platform toward said upper end of said left swing arm and for yieldably drawing said left cable lead into frictional engagement with said left drag pulley; and second resilient means for biasing said left foot platform toward said upper end of said left swing arm and for yieldably drawing said right cable lead into frictional engagement with said right drag pulley.

17. A skiing simulator system as set forth in claim 1:

wherein each of said foot platforms includes:

a foot support pad;

a ball joint pivotally mounting said foot support pad on said foot platform for universal movement thereon through a first range of motions and through a second range of motions;

brake means operable for arresting motion of said associated swing arm; and brake operating means including detector means on said foot platform spaced from said ball joint and responsive to said foot support pad for operating said brake means when said foot support pad moves through the first range of motions and ineffective to operate said brake means when said foot support pad moves through the second range of motions.

18. A skiing simulator system as set forth in claim 17:

wherein said brake means includes:

a u-shaped track member fixed on said frame having an elongated channel lying in a plane parallel to said swing arms and spaced therefrom;

a wheel follower including an axle for rolling engagement with said track member in said channel;

a link pivotally connecting said swing arm to said axle;

a brake shoe in said channel movable between a first position engaged with said wheel follower and a second position disengaged from said wheel follower; and wherein said brake operating means includes:

an actuator responsive to the position of said foot support pad to move said brake shoe between the first and second positions.

19. A skiing simulator system as set forth in claim 18 including:

left and right ski poles extending between a foot end and a handle end; and universal hinge means mounting said foot end of said ski poles on said frame at locations spaced from said swing arms.

20. A skiing simulator system as set forth in claim 19:

wherein said universal hinge means includes:

an elastomeric member fixed to and extending between said frame and said foot end of said ski pole.

21. A skiing simulator system as set forth in claim 1 including:

an elastic band removably attached to, and extending between, said left foot platform and said right foot platform.

22. A skiing simulator system as set forth in claim 1 including:

a rigid spacer bar removably attached to, and extending between, said left foot platform and said right foot platform.

23. A skiing simulator system combining both ski training and exercise comprising:

a frame;

a generally upright left swing arm extending between upper and lower ends being pivotally mounted on said frame at said upper end with said lower end of said left swing arm being free to swing through a first arc resulting in both lateral and elevational travel of said lower end;

a generally upright right swing arm extending between upper and lower ends being pivotally mounted on said frame at said upper end at a location on said frame laterally spaced from said left swing arm, said lower end of said right swing arm being free to swing through a second arc which is coplanar with the first arc resulting in both lateral and elevational travel of said lower end;

a left foot platform adapted to receive the left foot of a subject and mounted on said left swing arm;

a right foot platform adapted to receive the right foot of a subject and mounted on said right swing arm;

each of said left foot platform and said right foot platform further adapted for elevational travel of said respective foot platforms along said respective swing arms, enabling the subject whose feet are received thereon to selectively cause said left foot platform and said right foot platform to travel through the first and second arcs, respectively, to thereby perform a series of successive stances and movements both laterally and elevationally which simulate a skiing run.

* * * * *